US007689151B2

(12) United States Patent
Katsuhara et al.

(10) Patent No.: US 7,689,151 B2
(45) Date of Patent: Mar. 30, 2010

(54) MULTI-COLOR IMAGE-FORMING APPARATUS, OPTICAL SENSOR, AND METHOD FOR THE SAME

(75) Inventors: Kenji Katsuhara, Osaka (JP); Katsuya Motohira, Tokyo (JP); Fumio Ogawa, Tokyo (JP)

(73) Assignees: Stanley Electric Co., Ltd., Tokyo (JP); Kyocera Mita Corporation, Osaka (JP)

( * ) Notice: Subject to any disclaimer, the term of this patent is extended or adjusted under 35 U.S.C. 154(b) by 54 days.

(21) Appl. No.: 11/550,905

(22) Filed: Oct. 19, 2006

(65) Prior Publication Data

US 2007/0110485 A1 May 17, 2007

(30) Foreign Application Priority Data

Oct. 21, 2005 (JP) ..... 2005-306870

(51) Int. Cl.
*G03G 15/00* (2006.01)

(52) U.S. Cl. ..... 399/301; 399/40; 399/64; 399/49

(58) Field of Classification Search ..... 399/301, 399/60, 62, 64, 49, 28, 32, 40, 39, 184, 195, 399/200

See application file for complete search history.

(56) References Cited

U.S. PATENT DOCUMENTS 6,658,221 B2 * 12/2003 Hama et al. ..... 399/49
6,687,472 B2 * 2/2004 Udaka et al. ..... 399/49
6,853,817 B2 * 2/2005 Suzuki ..... 399/49

FOREIGN PATENT DOCUMENTS

JP 1167769 7/1989

* cited by examiner

*Primary Examiner*—David M Gray
*Assistant Examiner*—G. M. Hyder
(74) *Attorney, Agent, or Firm*—Cermak Kenealy Valdya & Nakajima LLP

(57) ABSTRACT

A multi-color image-forming apparatus having image-forming sections for a plurality of different colors can include an optical sensor having a light-casting section that casts single polarized light and a light-receiving section that receives polarized light different from the cast light. A pattern for detecting toner positions can be used in which toner having high reflectance to a particular light emission wavelength is independently formed. In addition, other patterns in which toner having low reflectance to the particular light emission wavelength are partially formed on a central portion of the pattern of high reflection toner by using the high reflection toner as a foundation. The apparatus can detect each toner pattern by the optical sensor to correct the color shift of each color.

15 Claims, 8 Drawing Sheets

MULTI-COLOR IMAGE-FORMING APPARATUS, OPTICAL SENSOR, AND METHOD FOR THE SAME

This application claims the priority benefit under 35 U.S.C. § 119 of Japanese Patent Application No. 2005-306870 filed on Oct. 21, 2005, which is hereby incorporated in its entirety by reference.

BACKGROUND

1. Field

The disclosed subject matter relates to a multi-color image-forming apparatus. In particular, the disclosed subject matter related to an image forming apparatus that detects the positions of ink, toner and the like in order to reduce the shift of printing position for each color (C (cyan), M (magenta), Y (yellow) and K (black)) when performing color printing by, for example, superposing the print of the colors.

2. Description of the Related Art

Conventionally, a method of correcting color shift using a CCD sensor has been known for multi-color image-forming apparati. FIG. 9 shows an example of a conventional multi-color image-forming apparatus that includes a transfer belt 90 and a CCD sensor 91 installed above the transfer belt 90.

Then, a positioning pattern 92 including each color C (cyan), M (magenta), Y (yellow) and K (black) is formed on the transfer belt 90 and, as shown in FIG. 9, irradiating light from an irradiation lamp 93 irradiates the positioning pattern 92. Reflected light is then read by the CCD sensor 91.

It is possible to use light in an infrared region (750 to 950 nm) as the irradiation light from the irradiation lamp 93 irradiating the positioning pattern 92. This is because the reading of the positioning pattern 92 can be detected at substantially the same sensitivity for each color.

The reflected light read by the CCD sensor 91 as described above is input to an MPU (main/central processing unit) and processed. The position of the positioning pattern is determined by the MPU, and the shift amount of registration is calculated. At this point, the transfer position of the positioning pattern is known, and transfer is performed by an instruction from the MPU when it is judged that the registration is in an allowable range by the MPU.

If it is judged by the MPU that the registration has deteriorated and exceeds an allowable range, the MPU calculates the error to find a shift amount. Then, a reflection mirror in a photosensitive optical path is activated by using a stepping motor in response to the shift amount to perform adjustment of at least one tilt in a sub-scanning direction, adjustment of parallel movement, or the like, and registration at the time of exposure by laser beam is matched. At this point, since the CCD sensor 91 can detect adhesion concentration as well, the same sensor combines the detection of position and adhesion concentration. (For example, see Japanese Patent Registration No. 2573855 gazette).

However, in the case of performing the positional detection of the pattern for each color (CMYK) by using the CCD sensor 91 as described above, there are several associated problems/drawbacks. For example, the CCD sensor 91 is expensive. In addition, the volume of data that is output from the CCD sensor 91 is enormous, requiring a high-speed MPU.

In addition, a light source such as an infrared light source, for example, is also required because the CCD sensor 91 itself does not have a light source.

SUMMARY

The disclosed subject matter is related to a multi-color image-forming apparatus having image-forming sections with a plurality of different colors, including: an optical sensor having a light-casting section that casts single polarized light and a light-receiving section that receives polarized light that is different from the cast light; at least one pattern configured to aid in detecting toner positions, where toner having high reflectance to emission wavelength is formed independently; and patterns where toner having low reflectance to emission wavelength are partially formed on the central portion of the pattern of toner having high reflectance by using the toner as a foundation, in which the apparatus detects each toner pattern by the optical sensor to correct the color shift of each color. An optical sensor for a multi-color image-forming apparatus can include: a light-emitting element of single-color emission; a polarizing optical element for casting light, which casts only light whose polarized direction is uniform on a detection target out of the light irradiated from the light-emitting element; a light-receiving element arranged so as to take in only a normal reflection component out of the reflected light from the detection target; and a polarizing optical element for receiving light, which makes only a polarized component different from the light cast onto the detection target incident to the light-receiving element, as specific means for solving the above-described conventional problems.

In the conventional reflection sensor, reflected light from the toner carrier (transfer belt) was also incident on the light-receiving element, so that a dynamic range was large when the difference of reflectance between the pattern and the toner carrier was large. Thus, a toner position could be easily fixed. However, the dynamic range between a color having high reflectance such as Y (yellow) and the toner carrier was not enough and the accuracy of fixing the position was also reduced.

Therefore, in the presently disclosed subject matter, the polarizing element for emission can be provided for the light-emitting element, and the polarizing element for receiving light can be provided for the light-receiving element to prevent the reflected light from the toner carrier, whose polarization is not disturbed, from being made incident to the light-receiving element. Thus, it is possible to reduce or eliminate the incidence of the reflected light from the toner carrier to the light-receiving element and to improve the detection accuracy of pattern position by the reflected light from toner.

In accordance with another aspect of the disclosed subject matter, a method of using the above described multi-color image-forming apparatus can include: detecting at least one of the high reflectance pattern and the low reflectance pattern through use of the optical sensor; and correcting for a color shift.

In accordance with another aspect of the disclosed subject matter, a method of manufacturing the multi-color image-forming apparatus can include: providing a control unit configured to control operation of the multi-color image-forming apparatus; providing a toner carrier located adjacent the optical sensor; and programming the control unit such that it controls the apparatus to produce at least one high reflectance pattern and at least one low reflectance pattern on the toner carrier.

In accordance with another aspect of the disclosed subject matter, a method of manufacturing the multi-color image-forming apparatus can include providing a high reflectance pattern that consists essentially of high reflectance toner, and providing a low reflectance pattern that includes a high reflectance toner bordered by a low reflectance toner.

BRIEF DESCRIPTION OF THE DRAWINGS

FIG. 3(*b*) is an explanatory view showing another example of an optical sensor made in accordance with principles of the disclosed subject matter.

FIG. 7(*b*) is an explanatory view showing yet another embodiment of an optical sensor made in accordance with principles of the disclosed subject matter.

DETAILED DESCRIPTION OF EXEMPLARY EMBODIMENTS

Figure 1:
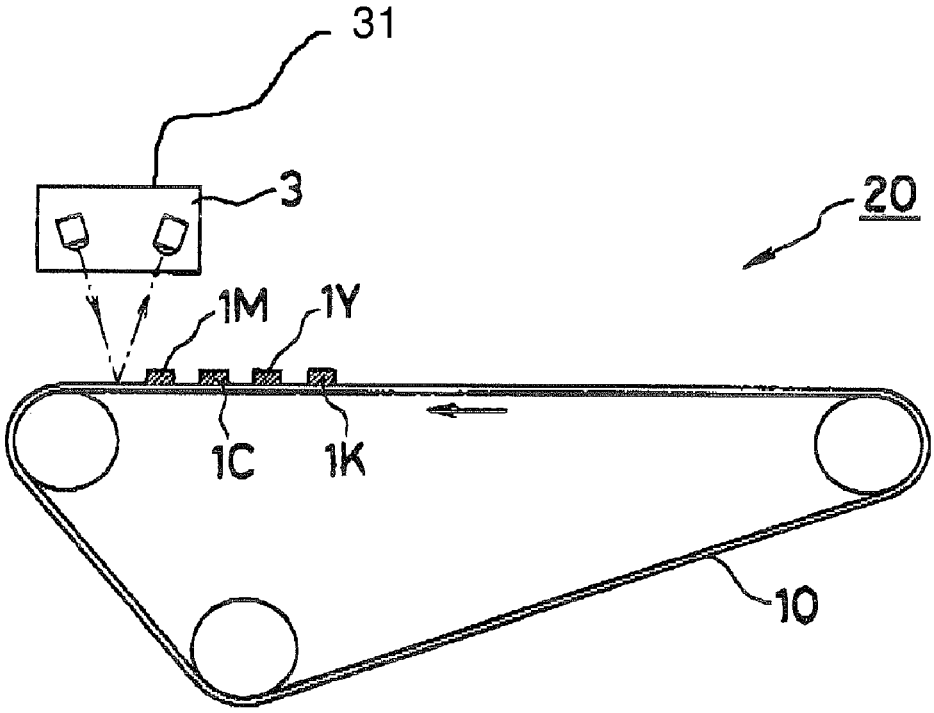
FIG. 1 is an explanatory view showing a portion of a multi-color image-forming apparatus made in accordance with principles of the disclosed subject matter.

Next, the disclosed subject matter will be described in detail based on exemplary embodiments shown in the drawings. FIG. 1 is a multi-color image-forming apparatus 20 made in accordance with principles of the disclosed subject matter, and includes a toner carrier 10. Patterns 1C, 1m, 1Y, and 1K for detecting toner position for each color (C, M, Y and K) are provided on the toner carrier 10, and an image is formed by using the patterns for detecting toner position 1 (C, M, Y, K) as a reference. Note that the description of components widely known for image forming such as a drum and exposure means is omitted in FIG. 1.

The image forming apparatus can also include a control unit 31 that is configured to control operation of the multi-color image-forming apparatus. The control unit can be programmed such that it controls the apparatus to produce at least one high reflectance pattern and at least one low reflectance pattern on the toner carrier in accordance with principles of the disclosed subject matter.

Figure 2:
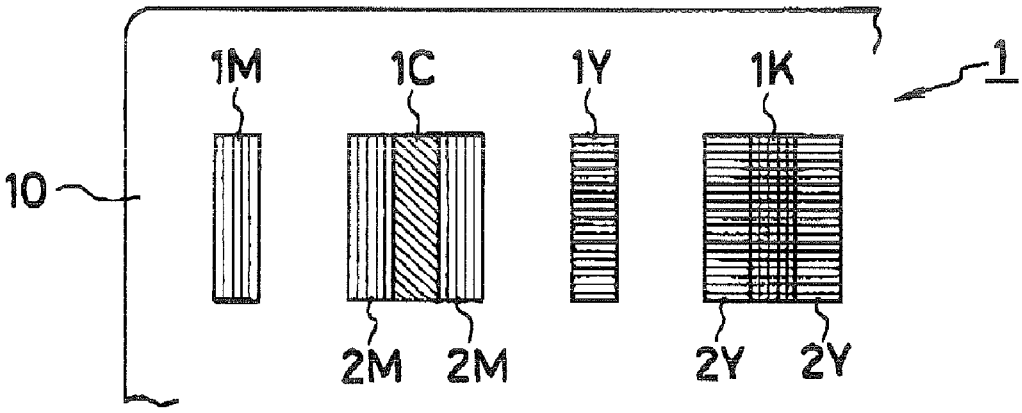
FIG. 2 is an explanatory view showing the installed state of patterns for detecting toner.

With regard to the patterns for detecting toner position 1 (C, M, Y, K), toner having high reflectance to the emission wavelength of the light-emitting element (magenta toner and yellow toner when a red LED is used as the light-emitting element, for example) can be used to form the patterns for detecting toner position 1, independently, as shown with the magenta toner pattern 1M and yellow toner pattern 1Y of FIG. 2.

Further, a foundation 2 can be formed by toner having high reflectance. The foundation can be located adjacent toner having low reflectance to the light emission wavelength (cyan toner and black toner in the case of the red LED, for example). For example, a cyan toner pattern 1C can be formed on the central portion of the upper surface of a magenta foundation 2M and a black toner pattern 1K can be formed on the central portion of the upper surface of a yellow foundation 2Y, as shown in FIG. 2.

Simple line shapes used for the pattern(s) are shown in FIG. 2. However, various other shapes, such as wedge shape(s), a cross shape(s), etc., are considered for use as the pattern(s) for detecting toner position (C, M, Y, K) for each color. The disclosed subject matter can be characterized in that the pattern(s) for detecting toner position which exhibit low reflectance to the light from the light source, can be formed on the foundation 2 which has high reflectance, in substantially any shape. Further, the toner (C, M, Y, K) can be used for both the patterns for detecting toner position 1 and the foundation 2.

Figure 3A:
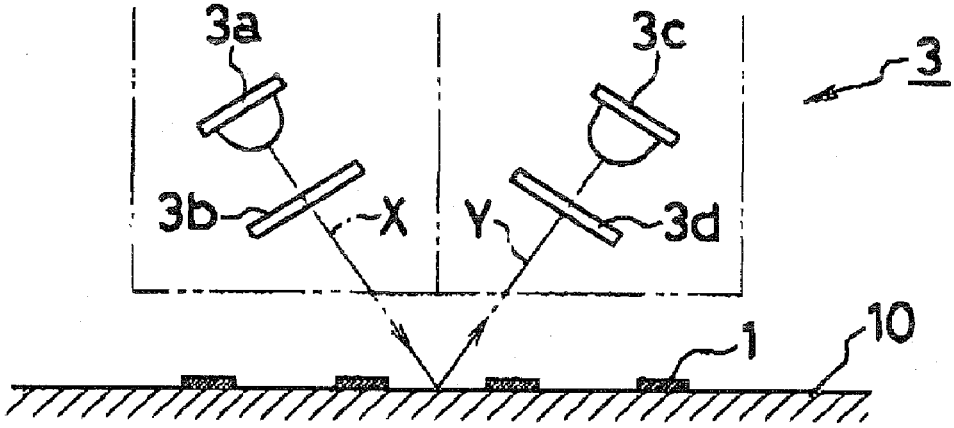
FIG. 3(*a*) is an explanatory view showing an example of an optical sensor made in accordance with principles of the disclosed subject matter.
Figure 3B:
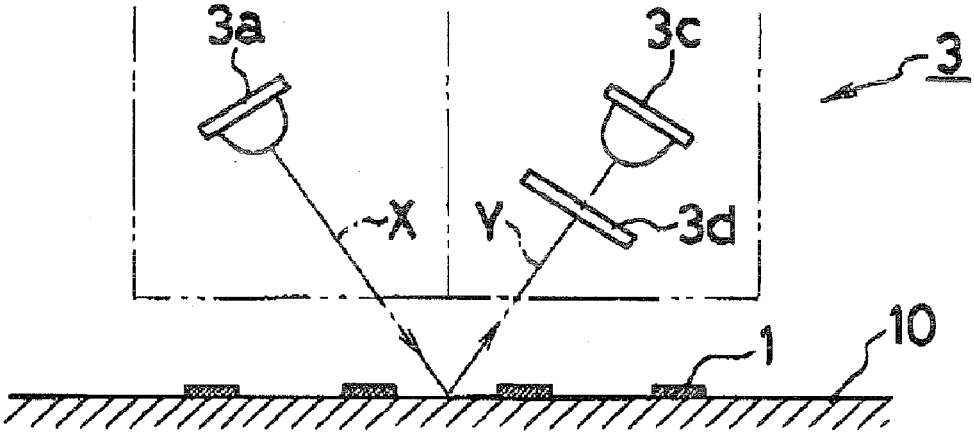

FIG. 3(*a*) shows the constitution of an optical sensor 3 that is configured to detect the patterns for detecting toner position, and can include: a light-emitting element 3*a* such as an LED or a laser diode; a polarizing optical element 3*b* that is configured to cast only light whose polarized direction is uniform from the light that is irradiated from the light-emitting element 3*a*; a light-receiving element 3*c* arranged so as to take in only a normal reflection component from the light reflected from the detection target; and a polarizing optical element 3*d* configured to permit substantially only a polarized component that is different from the light cast onto the detection target to be incident on the light-receiving element 3*c*. Note that the polarizing optical element 3*b* can be omitted when the light-emitting element 3*a* is a laser diode, as shown in FIG. 3(*b*).

Figure 4:
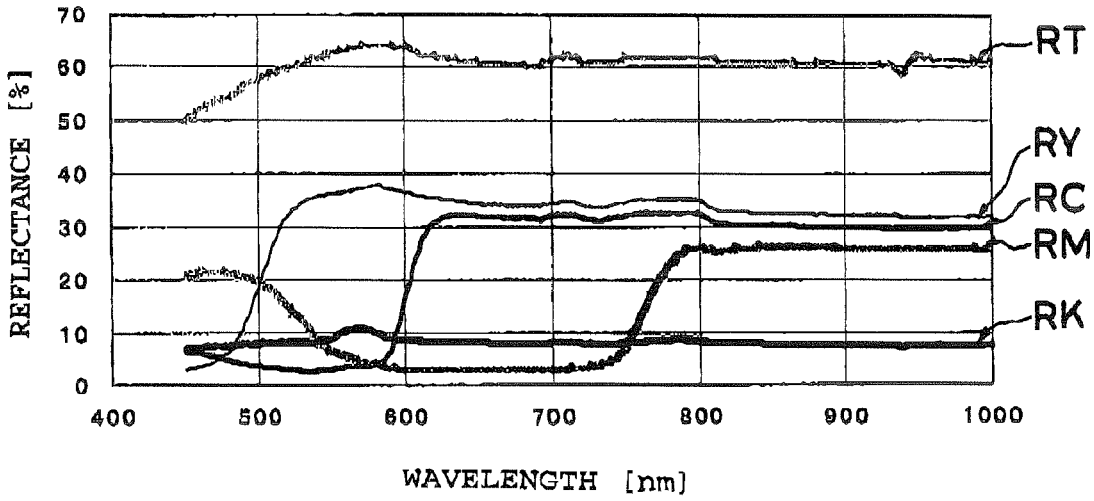
FIG. 4 is a graph showing reflection characteristics of each toner as compared to wavelength of light.

FIG. 4 is a graph showing the spectral reflectance of toner of each color, in which a curve RM, a curve RC, a curve RY, a curve RK and a curve RT respectively show the spectral reflectance for the magenta toner, the cyan toner, the yellow toner, the black toner, and the toner carrier. Therefore, detected sensitivity in each wavelength is a value obtained by subtracting the reflectance of the toner from the reflectance of the curve RT of the same wavelength. As can be seen, a considerable difference exists between numerical values obtained at different wavelengths.

Accordingly, the emission wavelength of the light-emitting element 3*a* should be about 620 to 720 nm of red color considering the spectral reflectance of toner of each color shown in FIG. 4, the reflectance of the toner carrier 10, and the cost of the polarizing optical elements 3*b*, 3*d*. However, it may be about 800 to 1000 nm of infrared light, and in this case, the foundation 2 is not necessary for the cyan toner pattern C and the foundation can be provided only for the black toner pattern 1K. Further, a PD (photodiode) and a phototransistor can be used as the light-receiving element 3*c*.

Figure 6:
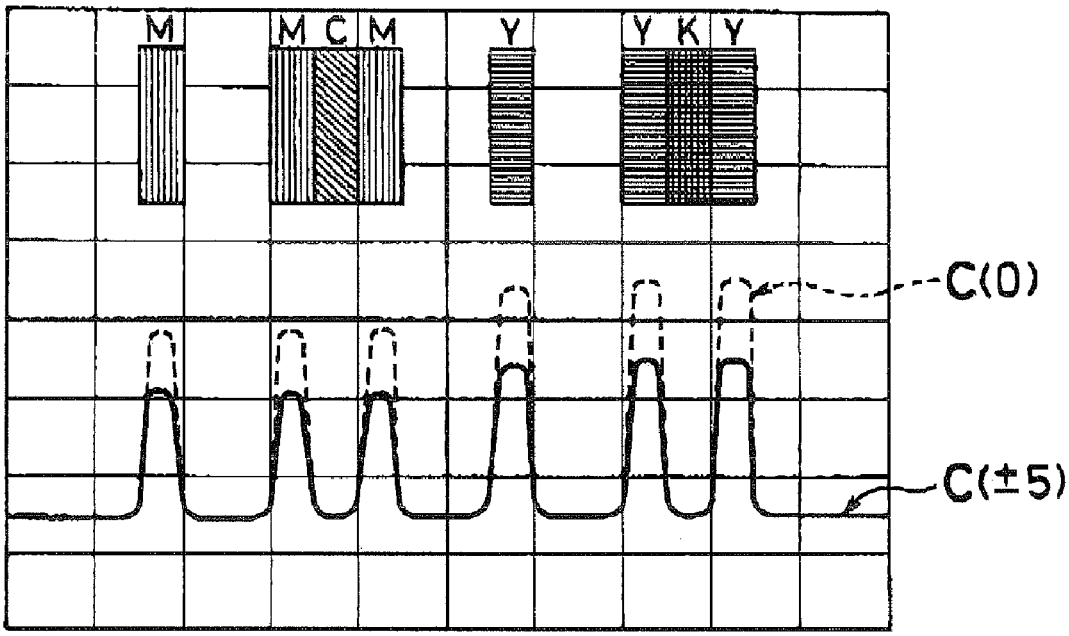
FIG. 6 is a graph showing the occurrence state of reflected light for positional detection generated by a multi color image forming apparatus made in accordance with principles of the disclosed subject matter.

The reflected light from the toner carrier 10 was made incident to the light-receiving element 3*c*. An output difference (dynamic range) of the light-receiving element 3*c* for cases with and without the patterns for detecting toner position (C, M, Y, K) was limited in a narrow range. By using a device as shown in FIG. 3, only light having a polarized component different from the cast light is made incident to the light-receiving element 3*c* by using the polarizing optical element. Thus, the device does not suffer from dispersion of reflectance of the toner carrier 10, as shown in FIG. 6.

Therefore, the output from the light-receiving element 3*c* when the patterns for detecting toner position do not exist becomes substantially zero. In other words, if the light quantity of the light-emitting element 3*a* is increased regardless of the presence of the toner carrier 10 and the dispersion of the reflectance of the toner carrier 10, the output from the light-receiving element 3*c* that measures the reflected light quantity from the patterns for detecting toner position also increases substantially in proportion to the increase of the light quantity, so that the dynamic range of a light-receiving output can be easily widened, S/N ratio increases, and thus pattern detection accuracy can be improved.

Further, in a conventional reflective sensor, the compound effect of the reflected light from the toner carrier 10 and the reflected light from the edge of the patterns for detecting toner position (C, M, Y, K) causes ripple(s) in output wavelength when detecting the vicinity of the patterns for detecting toner position (C, M, Y, K).

Figure 5A:
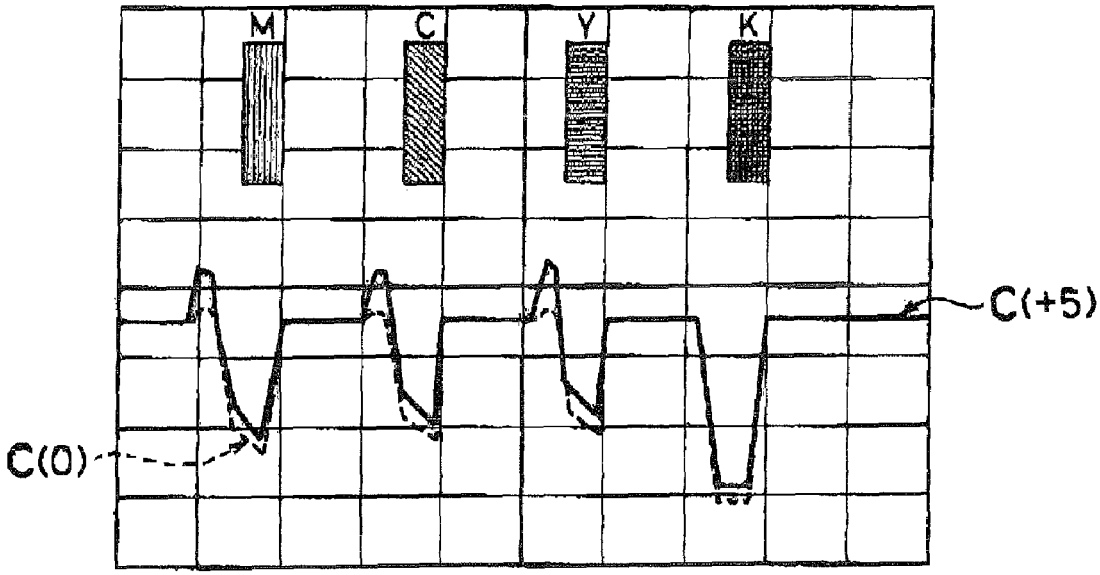
FIGS. 5(*a*) and 5(*b*) are graphs showing the interference state of a toner carrier and toner when reflecting light is irradiated from a front area and a rear area, respectively.
Figure 5B:
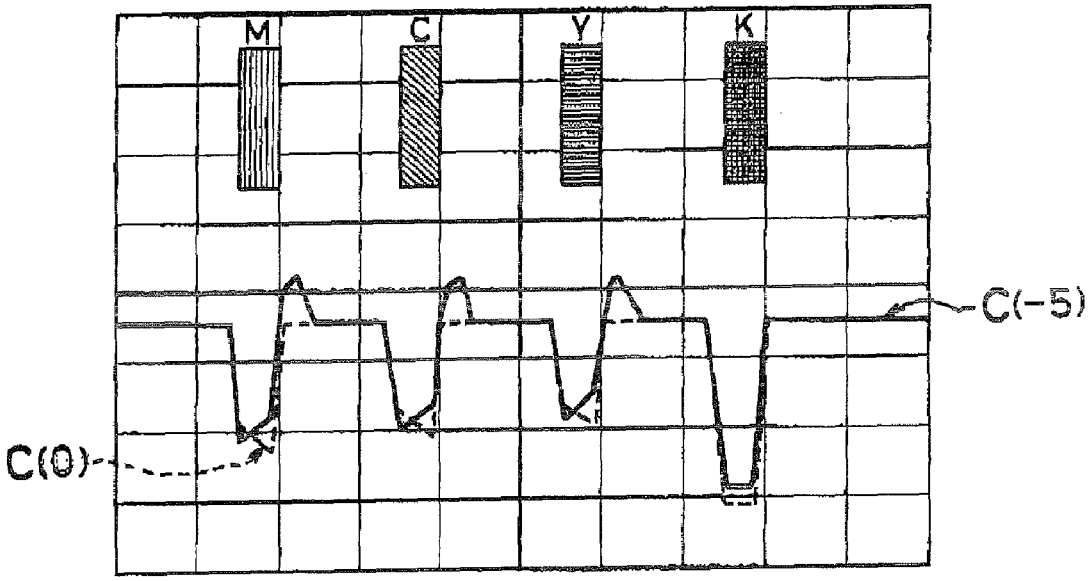

The ripple may be strongly affected by a positional relationship between the detection target and the sensor, particularly from an irradiating direction, where the ripple is caused in the front area of detected wavelength output as shown by a curve C (+5) in FIG. 5(A) when light is irradiated from an area closer to the front. The ripple can be caused in the rear area of the detected wavelength output as shown by a curve C (−5) in FIG. 5(B) when light is irradiated from an area closer to the rear.

Therefore, detection accuracy deteriorated due to the dispersion angle at which the sensor was attached since the shape of the detected wavelength output was significantly changed from the case shown by a curve C(0) indicated in a broken line in the drawing where light was irradiated from right above the target. However, in a multi-color image-forming apparatus 20 in which the reflected light from the toner carrier 10 is not made incident to the light-receiving element 3*c*, an output shown by a curve C (±5) in FIG. 6 obtained when light is irradiated from front and rear oblique directions and an output shown by a curve C(0) obtained when light is irradiated from right above the target do not cause a positional difference. Thus, the dispersion angle in attaching the sensor does not affect the accuracy, and highly accurate detection of pattern position can be performed.

As shown in FIG. 6, when toner having high reflectance is used as a foundation for toner having low reflectance, positional detection to the toner having high reflectance is performed by convex portions of output, and positional detection to the toner having low reflectance is performed by concave portions in the reflected light from the foundation 2.

Figure 7A:
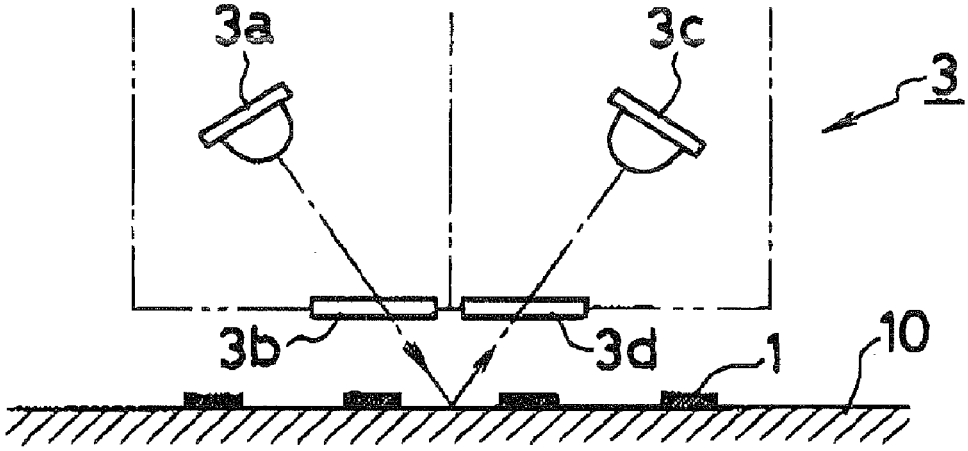
FIG. 7(*a*) is an explanatory view showing another embodiment of an optical sensor made in accordance with principles of the disclosed subject matter.
Figure 7B:
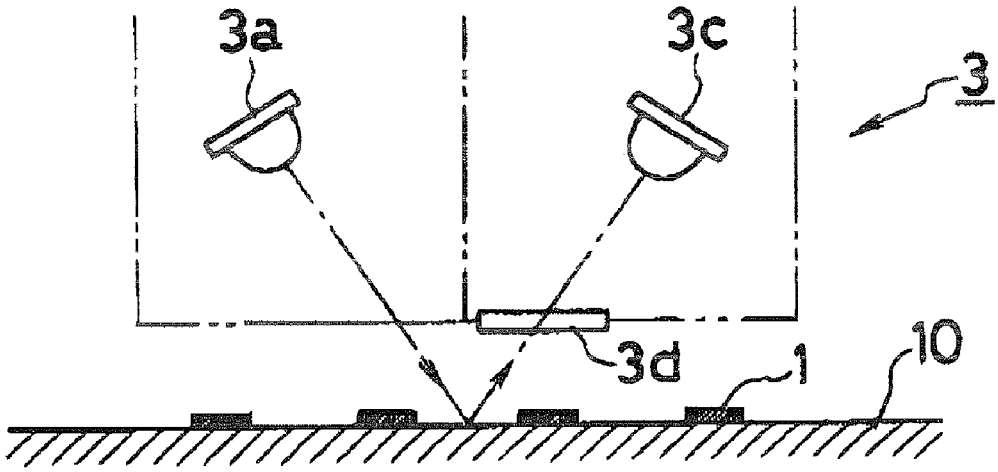

FIG. 7(*a*) shows another embodiment of an optical sensor 3 made in accordance with principles of the disclosed subject matter. In the previous embodiment, the polarizing optical element 3*b* for casting light was installed so as to be orthogonal to axis X of the light-emitting element 3*a*, and at the same time, the polarizing optical element 3*d* for receiving light was installed to be orthogonal to axis Y of the light-receiving element 3*c*. The polarizing optical element 3*b* for casting light and the polarizing optical element 3*d* for receiving light are installed substantially parallel to the toner carrier 10 in the embodiment of FIGS. 7(*a*)-(*b*). Note that the polarizing optical element 3*b* for casting light can be omitted when the light-emitting element 3*a* is a laser diode, as shown in FIG. 7(*b*).

Figure 8:
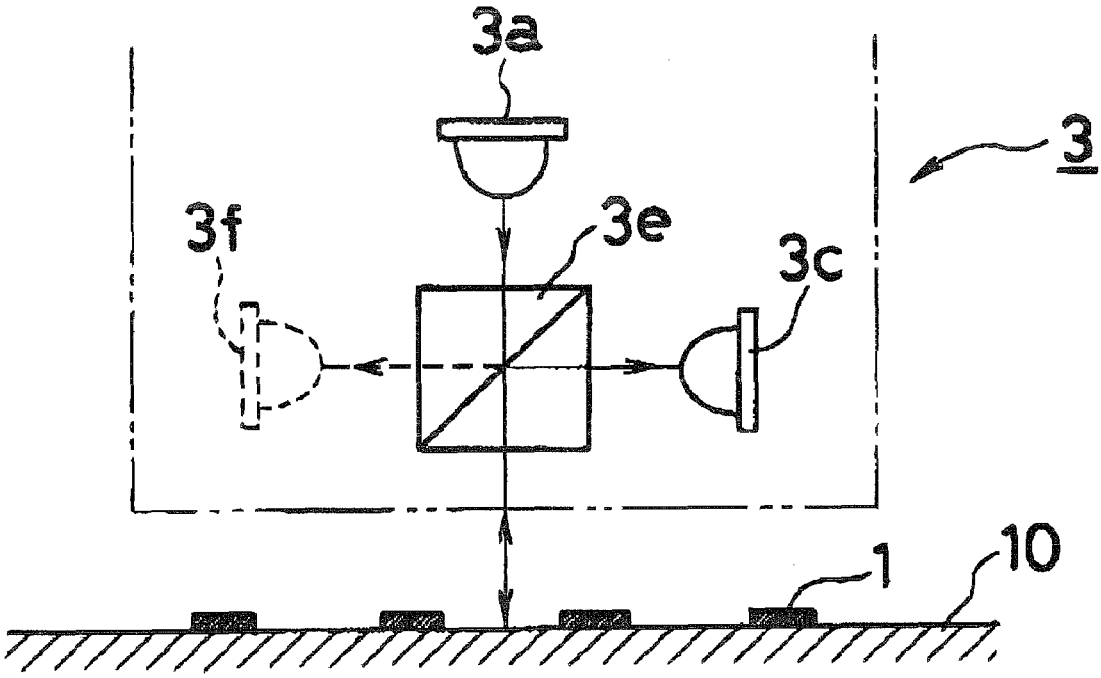
FIG. 8 is an explanatory view showing another embodiment of an optical sensor made in accordance with principles of the disclosed subject matter.
Figure 9:
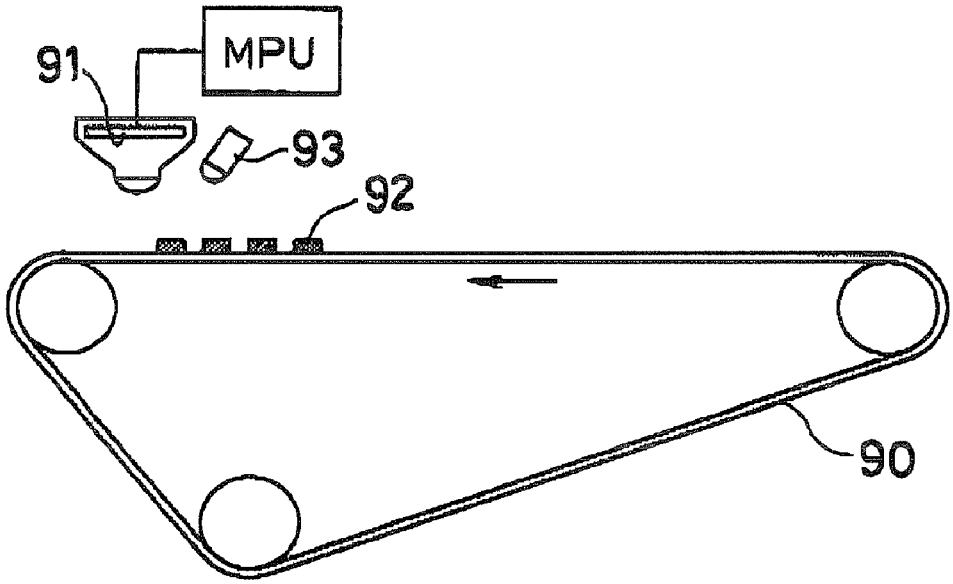
Fig. 9 Conventional Art
FIG. 9 is an explanatory view showing a conventional example of a multi-color image-forming apparatus.

As described, the polarizing optical elements for casting light and receiving light 3*b*, 3*d* may be arranged in parallel or, alternatively, a polarizing beam splitter 3*e* may also be used as shown in the embodiment of FIG. 8. When the polarizing beam splitter 3*e* is used, light (from an area other than light to be cast onto the detection target from the light emitted from the light-emitting element 3*a*) can be made incident to a light-receiving element 3*f* for monitoring, as shown by a broken line in FIG. 8. Thus, feedback control may be provided to the light-emitting element 3*a* so as to fix output, for example.

The disclosed subject matter is applicable for a color image forming apparatus such as a copying machine and a printer, which utilizes an electrophotograph system and also for a use where a color image is formed by accurately superposing dots or the like of cyan (C), magenta (M), yellow (Y) and black (K).

While there has been described what are at present considered to be exemplary embodiments of the invention, it will be understood that various modifications may be made thereto, and it is intended that the appended claims cover such modifications as fall within the true spirit and scope of the invention

What is claimed is:

1. A multi-color image-forming apparatus comprising:

an optical sensor having a light-casting section that casts light that is polarized in a predetermined direction and a light-receiving section that receives light that is polarized in a direction different from the predetermined direction;

at least one high reflectance pattern configured for detecting toner position and including a high reflectance toner having high reflectance to a particular wavelength of the light cast by the light-casting section; and at least one low reflectance pattern including a high reflectance toner foundation and a low reflectance toner portion formed on top of the high reflectance toner foundation within a central portion of the high reflectance toner foundation, wherein the low reflectance toner having low reflectance to the particular wavelength of the light cast by the light-casting section, wherein the apparatus is configured to detect at least one of the high reflectance pattern and the low reflectance pattern by the optical sensor to correct a color shift;

wherein the particular wavelength of the light cast by the light-casting section is from substantially 620 nm to substantially 720 nm, said high reflectance toner is at least one of a magenta (M) toner and a yellow (Y) toner, and said low reflectance toner is at least one of a cyan (C) toner and a black (K) toner; and wherein when the magenta (M) toner forms the high reflectance toner foundation, the cyan (C) toner forms the low reflectance toner portion and when the yellow (Y) toner forms the high reflectance toner foundation, the black (K) toner forms the low reflectance toner portion.

2. The multi-color image-forming apparatus according to claim 1, wherein the optical sensor includes, a light-emitting element configured to emit a substantially single-color emission light;

a first polarizing optical element configured to cast substantially only the light having the predetermined polarization direction onto a detection target, a light-receiving element configured to receive substantially only light having a polarization component different from the light that is cast from the first polarizing element and reflected from the detection target, and a second polarizing optical element configured to receive light and to cast only a polarized light component that is different from the light cast onto the detection target, to the light-receiving element.

3. The multi-color image-forming apparatus according to claim 1, wherein the optical sensor includes, a laser diode light-emitting element of substantially single-color light emission configured to emit light towards a detection target, a light-receiving element configured to receive substantially only light having a polarization component different from the light that is emitted from the laser diode and reflected from the detection target, and a polarizing optical element configured to receive light and to cast substantially only a polarized light component that is different from the light cast onto the detection target, to the light-receiving element.

4. The multi-color image-forming apparatus of claim 1, wherein the at least one high reflectance pattern is formed independent from the at least one low reflectance pattern.

5. A method of using a multi-color image-forming apparatus including an optical sensor having a light-casting section that casts light that is polarized in a predetermined direction and a light-receiving section that receives light that is polarized in a direction different from the predetermined direction, at least one high reflectance pattern configured for detecting toner position and including a high reflectance toner having high reflectance to a particular wavelength of the light cast by the light-casting section, and at least one low reflectance pattern including a high reflectance toner foundation and a low reflectance toner portion formed on top of the high reflectance toner foundation within a central portion of the high reflectance toner foundation, wherein the low reflectance toner having low reflectance to the particular wavelength of the light cast by the light-casting section, wherein said high reflectance toner is at least one of a magenta (M) toner and a yellow (Y) toner, and said low reflectance toner is at least one of a cyan (C) toner and a black (K) toner, the method comprising:

casting light by the light-casting section having a wavelength from substantially 620 nm to substantially 720 nm;

using the cyan (C) toner to form the low reflectance toner portion when the magenta (M) toner forms the high reflectance toner foundation, and using the black (K) toner to form the low reflectance toner portion when the yellow (Y) toner forms the high reflectance toner foundation;

detecting at least one of the high reflectance pattern and the low reflectance pattern through use of the optical sensor; and correcting for a color shift.

6. A method of manufacturing a multi-color image-forming apparatus including an optical sensor having a light-casting section that casts light that is polarized in a predetermined direction and a light-receiving section that receives light that is polarized in a direction different from the predetermined direction, at least one high reflectance pattern configured for detecting toner position and including a high reflectance toner having high reflectance to a particular wavelength of the light cast by the light-casting section, and at least one low reflectance pattern including a high reflectance toner foundation and a low reflectance toner portion formed on top of the high reflectance toner foundation within a central portion of the high reflectance toner foundation, wherein the low reflectance toner having low reflectance to the particular wavelength of the light cast by the light-casting section, and said high reflectance toner is at least one of a magenta (M) toner and a yellow (Y) toner, and said low reflectance toner is at least one of a cyan (C) toner and a black (K) toner, the method comprising:

configuring the apparatus to detect at least one of the high reflectance pattern and the low reflectance pattern by the optical sensor to correct a color shift, configuring the light-casting section to cast light having a wavelength from substantially 620 nm to substantially 720 nm, wherein when the magenta (M) toner forms the high reflectance toner foundation, the cyan (C) toner forms the low reflectance toner portion, and when the yellow (Y) toner forms the high reflectance toner foundation, the black (K) toner forms the low reflectance toner portion;

providing a control unit configured to control an operation of the multi-color image-forming apparatus;

providing a toner carrier located adjacent the optical sensor; and programming the control unit such that it controls the apparatus to produce at least one high reflectance pattern and at least one low reflectance pattern on the toner carrier.

7. The method of manufacturing the multi-color image-forming apparatus of claim 6, wherein the high reflectance pattern consists essentially of high reflectance toner, and the low reflectance pattern includes a low reflectance toner bordered by a high reflectance toner.

8. A multi-color image-forming apparatus comprising:

an optical sensor having a light-casting section that casts light that is polarized in a predetermined direction and a light-receiving section that receives light that is polarized in a direction different from the predetermined direction;

at least one high reflectance pattern configured for detecting toner position and including a high reflectance toner having high reflectance to a particular wavelength of the light cast by the light-casting section; and at least one low reflectance pattern including a high reflectance toner foundation and a low reflectance toner portion formed on top of the high reflectance toner foundation within a central portion of the high reflectance toner foundation, wherein the low reflectance toner has low reflectance to the particular wavelength of the light cast by the light-casting section, wherein the apparatus is configured to detect at least one of the high reflectance pattern and the low reflectance pattern by the optical sensor to correct a color shift;

wherein said high reflectance toner is at least one of a magenta (M) toner and a yellow (Y) toner and a cyan (C) toner, and said low reflectance toner is a black (K) toner; and wherein the yellow (Y) toner forms the high reflectance toner foundation and the black (K) toner forms the low reflectance toner portion.

9. The multi-color image-forming apparatus according to claim 8, wherein the optical sensor includes, a light-emitting element configured to emit a substantially single-color emission light;

a first polarizing optical element configured to cast substantially only the light having the predetermined polarization direction onto a detection target, a light-receiving element configured to receive substantially only light having a polarization component different from the light that is cast from the first polarizing element and reflected from the detection target, and a second polarizing optical element configured to receive light and to cast only a polarized light component that is different from the light cast onto the detection target, to the light-receiving element.

10. The multi-color image-forming apparatus according to claim 8, wherein the optical sensor includes, a laser diode light-emitting element of substantially single-color light emission configured to emit light towards a detection target, a light-receiving element configured to receive substantially only light having a polarization component different from the light that is emitted from the laser diode and reflected from the detection target, and a polarizing optical element configured to receive light and to cast substantially only a polarized light component that is different from the light cast onto the detection target, to the light-receiving element.

11. A method of using the multi-color image-forming apparatus of claim 8, comprising:

detecting at least one of the high reflectance pattern and the low reflectance pattern through the use of the optical sensor; and correcting for a color shift.

12. A method of manufacturing the multi-color image-forming apparatus of claim 8, comprising: providing a control unit configured to control an operation of the multi-color image-forming apparatus;

providing a toner carrier located adjacent the optical sensor; and programming the control unit such that it controls the apparatus to produce at least one high reflectance pattern and at least one low reflectance pattern on the toner carrier.

13. The method of manufacturing the multi-color image-forming apparatus of claim 12, wherein the high reflectance pattern consists essentially of high reflectance toner and the low reflectance pattern includes a low reflectance toner bordered by a high reflectance toner.

14. The multi-color image-forming apparatus of claim 8, wherein the at least one high reflectance pattern is formed independent from the at least one low reflectance pattern.

15. The multi-color image-forming apparatus of claim 8, wherein the particular wavelength of the light cast by the light-casting section is from substantially 800 nm to substantially 1000 nm.

* * * * *